United States Patent [19]

Dillon

[11] 4,129,980

[45] Dec. 19, 1978

[54] FRICTION DISCS FOR FALSE-TWIST HEAD

[75] Inventor: Roy E. Dillon, Stoneville, N.C.

[73] Assignee: Macfield Texturing, Inc., Madison, N.C.

[21] Appl. No.: 870,374

[22] Filed: Jan. 18, 1978

[51] Int. Cl.[2] ..... D02G 1/04

[52] U.S. Cl. ..... 57/339; 57/348

[58] Field of Search ..... 57/77.3, 77.4, 77.45

[56] References Cited

U.S. PATENT DOCUMENTS

| | | | |
|---|---|---|---|
| 3,350,870 | 11/1967 | Giuizza | 57/77.4 |
| 3,901,011 | 8/1975 | Schuster | 57/77.4 |
| 3,940,914 | 3/1976 | Schuster | 57/77.4 |
| 3,994,123 | 11/1976 | Sholly | 57/77.4 X |
| 4,051,655 | 10/1977 | Lorenz et al. | 57/77.4 |

*Primary Examiner*—Donald Watkins

[57] ABSTRACT

In a false twist or friction twist texturing machine of the type wherein a plurality of rotatably mounted spindles each carry a plurality of friction discs which overlap and through which a thread is passed along a zig-zag path between the spindles and over the edges of the friction discs, the friction disc assemblies are improved to the extent that they are formed of a circular base member extending outwardly from an arbor which is then mounted on one of the spindles. Such base members include an inwardly extending peripheral groove and a separate, ring-shaped friction member formed of a resilient material having a relatively high coefficent of friction and formed of such size and shape as to be releasably snap-fit into the groove, whereby when worn out the ring is replaced and the base member reused.

5 Claims, 4 Drawing Figures

FRICTION DISCS FOR FALSE-TWIST HEAD

BACKGROUND OF THE INVENTION

In the textile industry in recent years there has been a considerable increase in the texturing of yarns. Yarn texturing is one of the processes by which yarn strands may be formed into a Textured yarns may be formed according to several known processes, some of which include the false-twist method, the knife-edge method, the stuffer box method and the knitdeknit technique. Of these techniques the false-twist method is most widely used and according to this technique friction twist assemblies are provided, each having a plurality of spindles carrying meshed friction discs thereon. Yarns are twisted, heat-set and untwisted in one operation by passing the yarn or thread along a zig-zag path between the spindles and over the edges of the friction disc attached thereto.

A typical spindle assembly includes three or more shafts, each of which has a plurality of circular friction discs or wheels extending radially outwardly from the spindles at spaced points therealong. The friction discs of the spindles, in operation, are intermeshed so that the yarn passes therebetween. An example of such apparatus is illustrated and described in the Schuster U.S. Pat. No. 3,901,011. Note also that it is conventional for each shaft of the spindle to have stacked thereon a plurality of friction discs. Each of such discs includes a flat wheel or base nember with the periphery having bonded thereto a resilient material having relatively high coefficient of friction such as polyurethane, and a hub extending axially upwardly from the central portion of the base member. The hub includes an opening therethrough by means of which one or more of the discs may be attached to the shaft.

Such discs are subjected to wear as the yarn passes over the surface of the polyurethane edge, and therefore the entire disc must be replaced on the average of about once every six months.

This is a relatively expensive operation in that each of the discs as illustrated in FIG. 1 of the Schuster patent is relatively expensive (currently costing approximately $1.75). Additionally, the spindle must be taken out of operation, broken apart, and the worn disc removed, which is also time consuming.

SUMMARY OF THE PRESENT INVENTION

The present invention, on the other hand, is directed to a different approach to the fabrication of the friction disc assemblies. In its most general terms according to the invention, the bearing edge, which is formed of a material having a relatively high coefficient of friction, is made as a separate, replaceable, ring shaped item which is snap-fit onto the base member. The base member is therefore made permanent and does not have to be removed from the spindle assembly when the edge becomes worn. When one ring member is worn it is merely removed from the peripheral groove in its associated base member and replaced by a new ring. The rings are formed of a material that is resilient and exhibits a slight stretch so that they may be snap-fit over the edge of the base members into the grooves. Once in the grooves the ring is not subjected to sufficient force by the yarn passing therethrough to dislodge it.

In a preferred embodiment the groove in the periphery of the base member is generally V-shaped, while the inner surface of the ring member which fits into the groove is shaped correspondingly thereto. It is preferred that the ring not be V-shaped, but rather have a truncated V-shape, in case there are burrs or slight imperfections at the very base of the groove in the ring which would tend to unseat or improperly seat the ring thereon. Also, the base members are all formed integrally on a single arbor with a plurality, usually three, of base or mounting members on each arbor. Since the base members never have to be replaced there is no need to form separate members, although such could be done if desired.

With this approach significant savings have been achieved. As stated hereinabove, formerly when the surface of the friction disc became worn (after about six months) the entire disc had to be thrown away, as the bearing surface could not be refurbished or replaced. Each spindle or texturing position conventionally requires nine such discs and each texturing machine includes hundreds of such positions. When it is considered that it is ordinary practice in texturing mills to have as many as several hundred such machines it can be seen that replacement of friction discs about every six months is extremely expensive. Whereas each of the friction discs now being used currently cost the mill approximately $1.75, the replaceable ring costs mills only about $0.30. The savings results over a period of time to approximately one-half cent per pound of yarn run. Assuming a 150 denier yarn and a production of one million pounds per week (a reasonable assumption), a texturing plant can save $5,000.00 per week by implementation of the present invention.

It is therefore an object of the present invention to provide an improved friction disc for false-twist yarn texturing machines.

It is another object of the present invention to provide an improved friction disc of the type described which achieves significant economies as far as replacement costs are concerned.

It is yet another object of the present invention to provide a new type of friction disc for false twist texturing machines in which the bearing surface over which the yarn passes is formed of a separable O-ring member which may be replaced when worn.

Other objects and a fuller understanding of the invention will become apparent from reading the following description of the preferred embodiment along with the accompanying drawings in which.

DETAILED DESCRIPTION OF A PREFERRED EMBODIMENT

Figure 1:
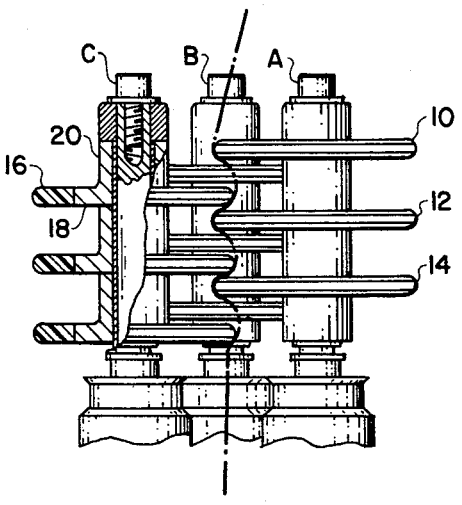
FIG. 1 Prior Art
FIG. 1 is a partially sectioned side view illustrating a three spindle texturing position having a conventional friction disc of a known type mounted thereon.

Turning to FIG. 1 there is illustrated a conventional texturing position according to the prior art comprising a plurality of spindles A, B, C. Each of the spindles, among other things, includes a plurality of friction discs 10, 12, and 14 stacked on the spindle. Looking at the sectioned portion of FIG. 1, it can be seen that each friction disc 10, 12, and 14 includes a peripheral bearing strip or member 16 which is conventionally molded onto the outer edge of a circular base member 18. In addition, the base member 18 includes an upstanding hub 20 for mounting the friction disc onto one of the spindle shafts.

Figure 3:
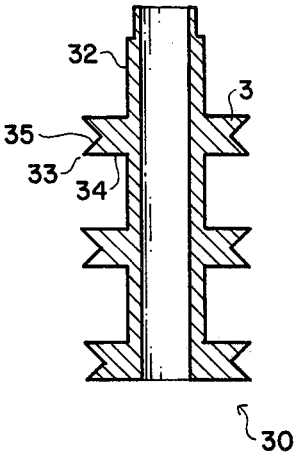
FIG. 3 is a sectional view of the arbor portion of the assembly shown in FIG. 2.
Figure 2:
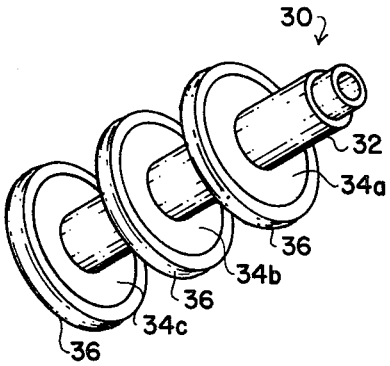
FIG. 2 is a perspective view of a new type of arbor according to the present invention with replaceable O-rings mounted thereon.
Figure 4:
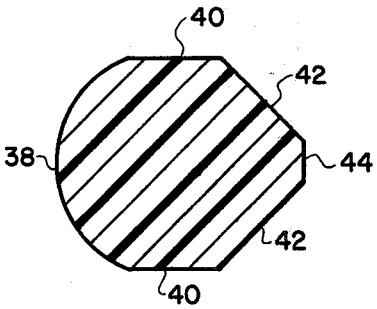
FIG. 4 is a cross-sectional view of the O-ring illustrated in FIG. 2.

FIGS. 2–4 show a preferred embodiment of the present invention which includes a one-piece arbor 30 comprising a tubular member 32 having secured thereto and extending radially outwardly therefrom a plurality of spaced wheels or circular base members 34*a*, 34*b*, 34*c*. Tubular member 32 extends between each of the base members 34*a*, 34*b*, 34*c* and provides a spacing means therebetween. A replaceable O-ring or member 36, which mounts on the base member 34, is formed of a resilient material having a relatively high coefficient of friction. The O-ring or ring-shaped member 36 is made removable from the base members 34 as will be described hereinafter.

Turning now to FIG. 3 there is illustrated the arbor 30 which includes tubular member 32 having a plurality of circular base members 34 secured thereto and extending radially outwardly therefrom at spaced positions therealong. Each of base members 34 includes preferably V-shaped, groove 35, extending around the periphery thereof. After considerable experimentation it has been found that the V-shape is preferable although other shapes might prove satisfactory; it only being necessary that the groove be of sufficient configuration to permit emplacement and removal of the ring members 36 therein and to retain the rings therein during operation.

In FIG. 4, there is illustrated a cross-section of the replaceable O-rings 36. In this regard, it is preferable that the O-ring have a curved outer configuration 38 which forms the bearing surface over which the yarn passes. From the opposite terminal edges of the curved outer edge 38, a pair of spaced, parallel side walls 40 extend inwardly therefrom. The inner surface 42 which fits into groove 35 is of a generally truncated, V-shape terminating in a flattened inner wall 44. It should be recognized that the periphery of the inner wall 44 is considerably less than the outer periphery of base member 34. In fact, the point where the side walls 40 of the ring member 36 and the angular walls 42 intersect is of a periphery slightly less than the outer edge 33 of circular base member 34 so that there is a slight stretch fit of the replaceable rings 36 onto the base members 34.

By use of the one-piece arbor 30 considerable economies are achieved. Using stacked friction discs as in the prior art devices, there must be maintained in inventory a supply of several types of discs because of the difference in hub length and disc diameters. Further, because the arbor 30 is fabricated as a single unitary construction the tolerances are going to be more consistent as opposed to a three-piece arbor which is conventional in the prior art. In such constructions the circular base members are made at different times and possibly even on different machines. Therefore, in such machines with separable base members, there is a possibility that the texturing operation will be less than satisfactory because of the buildup of tolerances between the three separate disc members on each spindle. Although the one-piece arbor is preferable it is easily recognized that it is not absolutely necessary to the practice of the present invention since obviously three-piece disc members with separable O-rings could also be stacked on a single spindle while easily maintaining the replacement and maintenance economies.

While a preferred embodiment has been illustrated and described in detail hereinabove, various changes and modifications in addition to those mentioned might also be made without departing from the scope of the invention which is set forth in the following set of claims. What is claimed is:

1. In a friction- or false-twist head construction of the type having a plurality of rotatably mounted spindles, each carrying a plurality of friction discs which overlap and through which head a thread is passed along a zig-zag path between the spindles and over the bearing edges of the friction discs, the improvement whereby the friction discs comprise:

(a) a circular base member having means associated therewith for mounting of said base on one of said spindles;

(b) said base member including an inwardly extending groove around the periphery thereof;

(c) a separate, ring-shaped member formed of a resilient material having a relatively high coeffecient of friction and also having a radially extending interior protrusion of such size and shape as to be releasably snap-fit into said groove in said base member;

(d) whereby no other securing technique is necessary to hold the ring-shape member on said base member and when worn out may be easily replaced, thereby repeatedly utilizing the same base member with a plurality of successively usable ring-shaped members.

2. The improvement in the construction of false-twist heads according to claim 1 wherein a plurality of said base members are formed integrally on a tubular shaft at spaced positions therealong.

3. The improvement in the construction of falsetwist heads according to claim 1 wherein said ring-shaped members are formed with an effective inner diameter less than the corresponding effective outer diameter of the groove in said base member whereby a stretch fit is achieved.

4. The improvement according to claim 1 wherein the groove in said base member and the corresponding surface of said ring-shaped member are both of a generally V-shape.

5. The improvement according to claim 1 wherein said ring-shaped member is polyurethane.

* * * * *